US007192360B2

(12) United States Patent
Tamulewicz

(10) Patent No.: US 7,192,360 B2
(45) Date of Patent: Mar. 20, 2007

(54) GOLF PRACTICE DEVICE

(76) Inventor: Brian J. Tamulewicz, 156 Maplelawn Dr., Berea, OH (US) 44017

( * ) Notice: Subject to any disclaimer, the term of this patent is extended or adjusted under 35 U.S.C. 154(b) by 0 days.

(21) Appl. No.: 11/140,689

(22) Filed: May 31, 2005

(65) Prior Publication Data

US 2006/0270484 A1 Nov. 30, 2006

(51) Int. Cl.
*A63B 69/36* (2006.01)

(52) U.S. Cl. ..... 473/162; 473/196

(58) Field of Classification Search ..... 473/150–197
See application file for complete search history.

(56) References Cited

U.S. PATENT DOCUMENTS

| | | | | |
|---|---|---|---|---|
| 2,677,547 | A | 5/1954 | Campbell | |
| 3,104,879 | A | 9/1963 | Jetton | |
| 3,264,001 | A | 8/1966 | Urban | |
| 3,490,769 | A | 1/1970 | Torbett | |
| 3,526,405 | A | 9/1970 | Morris | |
| 3,578,333 | A | 5/1971 | Elesh | |
| 3,990,573 | A * | 11/1976 | Cross | 190/115 |
| 4,017,084 | A * | 4/1977 | Jeffery | 473/162 |
| 4,171,134 | A | 10/1979 | Reck | |
| 4,244,576 | A * | 1/1981 | Mosier et al. | 473/159 |
| 4,281,834 | A | 8/1981 | Chavez | |
| D264,114 | S | 4/1982 | Wojciechowski | |
| 4,531,742 | A * | 7/1985 | Craycraft | 473/165 |
| 4,711,260 | A | 12/1987 | Wiens et al. | |
| 5,383,665 | A * | 1/1995 | Schultz et al. | 473/159 |
| 5,401,027 | A | 3/1995 | Surbeck | |
| 5,435,560 | A | 7/1995 | Kehoe | |
| 5,441,267 | A * | 8/1995 | Alder | 473/173 |
| 5,580,320 | A | 12/1996 | Meikle | |
| 5,779,567 | A | 7/1998 | Durso | |
| 5,830,076 | A | 11/1998 | Borys | |
| D411,601 | S | 6/1999 | Fong | |
| 6,083,114 | A | 7/2000 | Bailey | |
| D435,618 | S | 12/2000 | Polk, III et al. | |
| 6,241,621 | B1 | 6/2001 | Maher | |
| 6,419,590 | B1 | 7/2002 | Criger | |
| 6,569,028 | B1 | 5/2003 | Nichols et al. | |
| 6,884,178 | B1 * | 4/2005 | Frost | 473/150 |

* cited by examiner

*Primary Examiner*—Mark S. Graham
(74) *Attorney, Agent, or Firm*—Hudak, Shunk & Farine Co. LPA

(57) ABSTRACT

A golf practice device that can be utilized for both practice as well as playing of one or more games. The golf practice device includes a base member adapted to be conformable and removably fixable to a ground surface, preferably utilizing securing elements included with the golf practice device. In a preferred embodiment, the base member is formed as a typical green on a golf course and can be a circle, oval, or non-geometric shape. In a further preferred embodiment, the base member includes indicia such as rings, lines, letters, numbers, symbols or the like, with rings being most preferred. The golf practice device further includes an aiming point such as a flagstick. The golf practice device of the present invention is foldable for storage when not in use and can be stored in a case which is relatively small and is designed to be easily carried in a standard golf bag.

18 Claims, 6 Drawing Sheets

GOLF PRACTICE DEVICE

FIELD OF THE INVENTION

The present invention relates generally to the field of golf aids and, more particularly, to a golf aid device that is used to practice target accuracy. In a preferred embodiment, the device includes a base member that is substantially conformable to a ground surface, is foldable, and can be stored in a relatively small package or case and is thus easily portable, such as in a golf bag.

BACKGROUND OF THE INVENTION

A variety of golf practice aids for target accuracy are commercially available. These prior art aids generally consist of multiple components requiring time to assemble and disassemble before and after use. Additionally, the prior art aids are generally cumbersome should one desire to include and store them with other golf accessories in their golf bag. Accordingly, there is a need in the art for an improved golf practice device that offers quick set-up and compact portability.

U.S. Pat. No. 5,830,076 discloses a golf practice apparatus which reportedly includes a foldable target in a carrying case that is sized to receive the folded target for transportation. The target has a base portion with the flag pole extending from the base portion. A plurality of arms is foldably connected to the base portion at a plurality of points. A flexible target area extends between the arms to form a surface onto which golf balls may be hit. The case has a main compartment sized to receive the folded target. A handle is coupled to the case to assist in transporting the case. A number of secondary compartments including a stake compartment and a ball compartment may be used to carry stakes and balls with a case.

U.S. Pat. No. 6,083,114 discloses an apparatus for collecting golf balls comprising a collection assembly having a canopy and a collection net selectively movable between an open position and a collapsed position. In design, the canopy is formed of a material having an outer radial portion engaging the distal ends of a plurality of support ribs. Similarly, the collection net has an outer radial portion engaging the distal ends of said support ribs such that the collection net is generally suspended in relation to an interior surface of the canopy. The collection net is preferably formed of a material capable of absorbing the impact of at least one projectile (e.g., golf ball) and distributing the impact force of the projectile through at least a section of the body of the collection net. An elongated shaft supportably engages the plurality of support ribs, thereby supporting the collection assembly. Operatively moveable in relation to the elongated shaft is an actuating assembly for selectively positioning the collection assembly between the open and collapsed positions. To support the collection assembly in the open position elative to an underlying surface, a support member is attached at the first end of the elongated shaft. A flag is also provided to serve as a visual target to a user when chipping and/or pitching into the collection assembly of the present invention.

U.S. Pat. No. 6,241,621 discloses a kit reportedly for use in practicing golf, comprising a putting target set, a lag putting target set, a chipping target set, and a general iron play target set. Each of the targets has a first substantially planar surface and second highly visible, substantially planar surface opposite and substantially parallel to the first substantially planar surface. The first substantially planar surface has a first surface area adapted to rest on a supporting surface, such as the ground, and the second substantially planar surface has a second surface area sufficient to carry at least a portion of a golf ball thereon when the first substantially planar surface rests on the supporting surface. Each of the targets is made of a material adapted to substantially conform to the supporting surface when the first surface rests on the supporting surface. Also, the overall sizes of targets in each of the sets are preferably different from each other. At least some of the targets include a plurality of eyelets having a size sufficient to receive a golf tee or golf ball marker to secure the targets to the ground. The targets in the lag putting kit also include substantially C-shaped cuts at their respective/centers, which form flap portions that can be received in a standard golf hole. One of the targets in the general iron play set may include a drawstring which enables that target to reportedly function as a carry sack to carry the remainder of the targets.

U.S. Pat. No. 6,419,590 discloses a scoring overlay in the form of a target and a system for reportedly improving golf putting. The overlay is designed for use after a golf putt to provide a score based on the position of the ball relative to the hole. The center of the overlay is placed over the hole on the golf green, and the overlay is oriented based on the direction from which the putt was made. A score is awarded based on the position of the ball on the overlay. Scores are based on how close the ball is to the hole; however, a higher score is awarded for a ball a given distance from the hole that was hit hard enough to reach or pass the hole than for a ball equally distant from the hole that was not hit hard enough to reach the hole. Similarly, lower scores are provided for golf balls hit off line from center, either far to the right or far to the left. This disclosure also includes a method for reportedly improving putting through a game using the overlay.

SUMMARY OF THE INVENTION

According to one aspect of the invention, the golf practice device can be utilized for both practice as well as playing of one or more games. The golf practice device includes a base member adapted to be conformable and removably fixable to a ground surface, preferably utilizing securing elements included with the golf practice device. In a preferred embodiment, the base member is formed as a typical green on a golf course and can be a circle, oval, or non-geometric shape. In a further preferred embodiment, the base member includes indicia such as rings, lines, letters, numbers, symbols or the like, with rings being most preferred. The rings serve to divide the base member into various fields of accuracy from a center or target area. The golf practice device further includes an aiming point such as a flagstick. The flagstick includes a plurality of elongated preferably cylindrical segments and one or more connectors to connect the segments together. The golf practice device of the present invention is foldable for storage when not in use and can be stored in a case which is relatively small and is designed to be easily carried in a standard golf bag.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
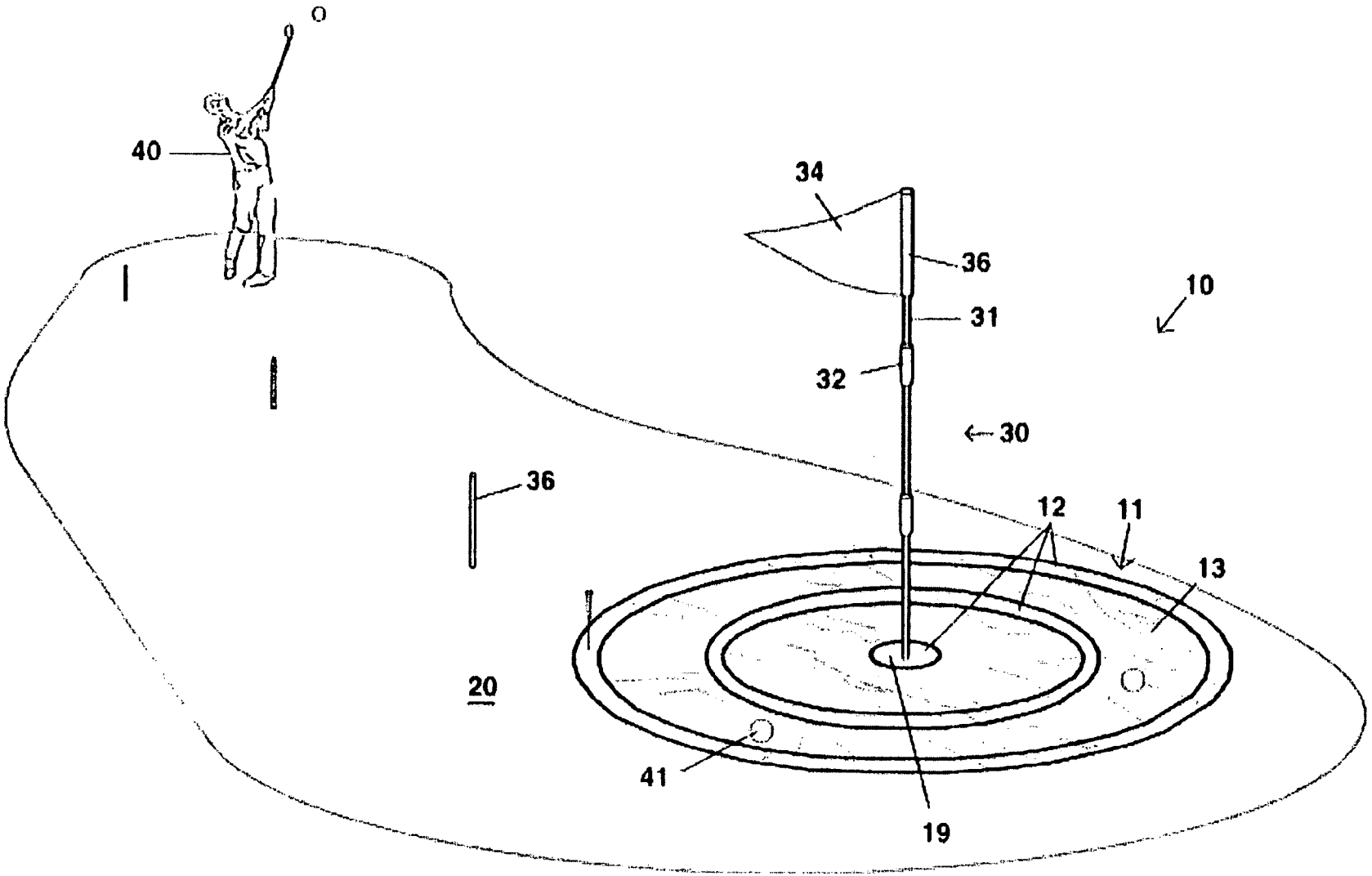
FIG. 1 is a perspective view of a golfer relative to one embodiment of the practice device according to the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, wherein like reference numerals refer to like parts, the golf practice device 10 relates to a golf game and practice kit in which multiple players can compete amongst each other or individuals practice their golfing skills, such as putting, chipping, or the like. The invention includes a base member 11 that is adapted to be affixed to a ground surface. The upper surface of base member 11 features indicia 12, graphic rings as illustrated, designating fields of accuracy to target area 19. A multi-piece flagstick 30 that breaks down into easily stored pieces passes through the center of the base member 11 and can be secured in ground surface 20. A flag 34 is included and can be secured to the top end of flagstick 30. Markers 36 in the kit provide a means of designating measured distances from the material. Base member 11 is constructed so that it can be folded, rolled and inserted within a case 50, such as a tote sleeve, along with all other components of the device for compact storage and portability.

In one embodiment of the invention, the golf practice device 10 includes a base member 11 preferably constructed of a material that can be woven, or non-woven, natural or synthetic, or combinations thereof, such as nylon, polyester, cotton, a polyolefin such as polyethylene or polypropylene or the like, vinyl, tyvek, canvas, mesh netting or any other material suitable in providing the functionality as described herein. In one embodiment, base member 11 is constructed of a material which simulates the feel or other characteristics of a typical golf green. Although the base member 11 is illustrated in the shape of a circle, the general profile can be any one of a multitude of different geometric or non-geometric shapes to include, but not limited to, a square, triangle, hexagon, oval, etc. Edges of the base member 11 are preferably finish stitched or heat sealed, or the like as known to one of ordinary skill in the art, if the material characteristics permit, to prevent undesirable fraying of the edges. While the base member 11 can generally be any length or width, the base material length ranges generally from about 1 to about 10 feet, and preferably from about 3 to about 5 feet, and has a width of generally from about 1 to about 10 feet and preferably from about 3 to about 5 feet. As stated hereinabove, the base member is preferably circular and has a diameter generally of about 2 to about 10 feet, and preferably from about 3 to about 5 feet.

Figure 2:
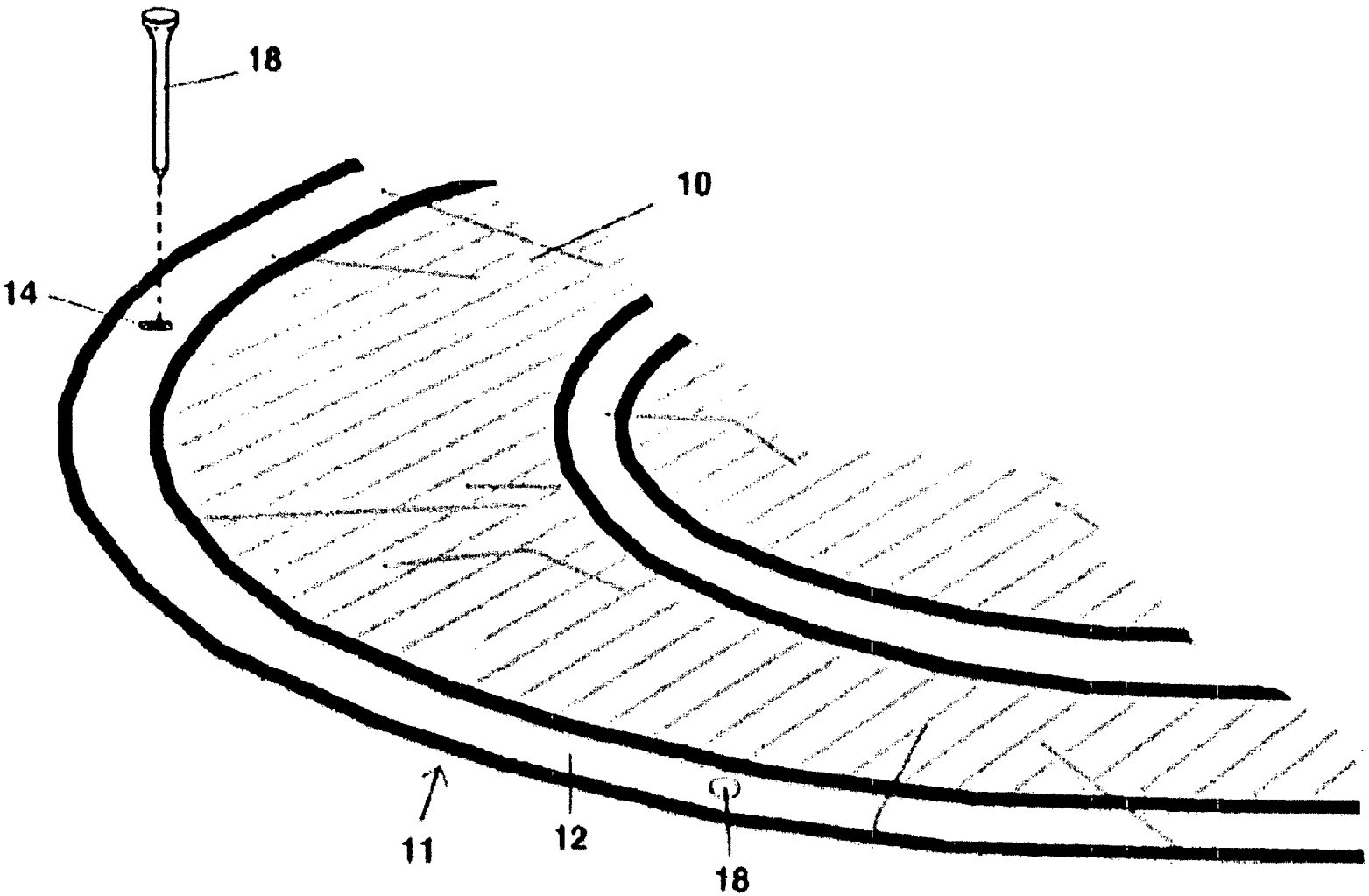
FIG. 2 is a partial perspective exploded view of one embodiment for securing the base member to a ground surface.
Figure 3:
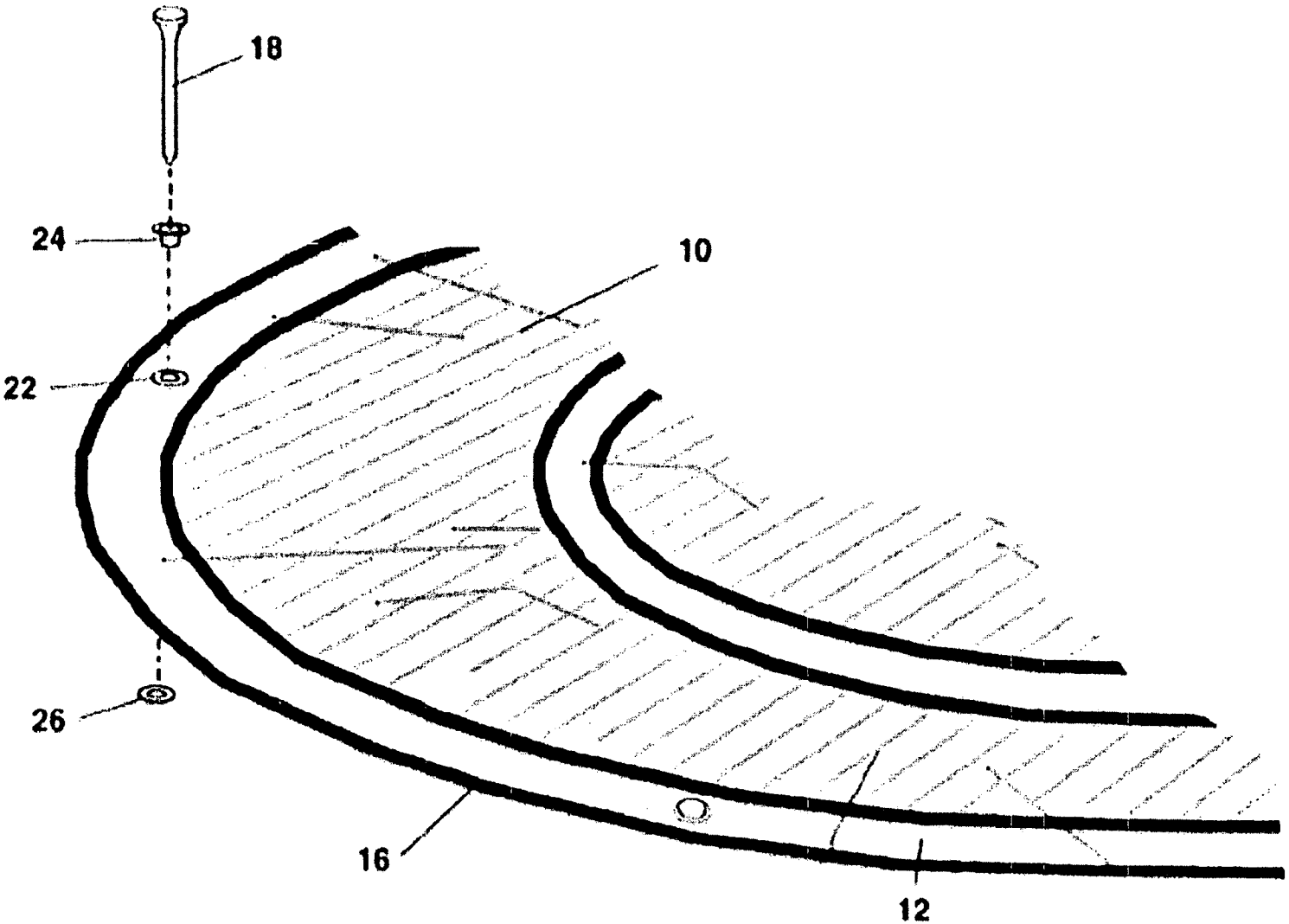
FIG. 3 is a partial perspective exploded view of an alternative embodiment for securing the base member to a ground surface.

In one embodiment, the upper surface 13 of base member 11 includes indicia 12, such as rings, lines, letters, numbers, symbols, or the like. FIGS. 1, 2 and 3 illustrate graphic rings which are preferably a different color than base member 11 material. The graphic rings, as illustrated, divide the base member into fields of accuracy to predetermined distances from target area 19 such as at about 6 inch or 1 foot intervals.

Base member 11 is desirably attached to a ground surface 20 utilizing one or more securing elements 18. The examples of suitable securing elements 18 include, but are not limited to, a golf tee, a nail, a screw, a stake, or the like. The preferred securing element includes a post which can be driven into the ground and a head which cannot pass through orifice 14 of base member 11. In order to removably attach base member 11 to ground surface 20, one or more apertures or orifices 14 are present on base member 11 at any desired location. In a preferred embodiment, orifices 14 are placed in base member 11 at spaced distances around the periphery thereof generally within the outside edge 16. In one embodiment, orifice 14 is a buttonhole, preferably reinforced, of appropriate size such that a golf tee or other securing element 18 cannot pass completely therethrough. In order to secure the base member to ground surface 20, as illustrated in FIG. 2, the securing element is pushed through orifice 14 from the upper surface thereof into the ground. It is also illustrated in FIG. 2 that securing element 18 has a head portion which cannot fit through aperture and, therefore, maintains the base member 11 removably connected to ground surface 20. The base member 11 is preferably free of rigid members such as arms, links, or the like which could possibly interfere with movement of ball 41 across the upper surface 13 thereof. Accordingly, the base member 11 preferably simulates the surface of a golf green.

Referring to FIG. 3, an alternate embodiment to the affixing detail in FIG. 2 is shown. In this embodiment, orifice 14 includes a grommet 22. The grommet 22 includes an eyelet having a top 24 and bottom 26 that is placed and is sized such that a head of securing element 18 cannot pass through. As with the apertures 14, the grommets are spaced apart from each other around the periphery of the outside edge 16.

Referring back to FIG. 1, the base member 11 is also constructed to accommodate and allow a preferably multi-piece flagstick 30 to pass through an aperture of target area 19. In one embodiment the flagstick is a single piece flagstick, but is preferably comprised of cylindrical segments 31 and connectors 32. Cylindrical segments 31 are preferably elongated, having substantially any desired length, and can be solid or hollow, or a combination thereof. Any number of cylindrical segments 31 can be utilized, but preferably the flagstick 30 includes a number of cylindrical segments and connectors 31 and 32 respectively in order to give the flagstick 30 a height of generally from about 6 to about 60 inches, and preferably from about 36 to about 48 inches. Connectors 32 are generally formed as a tube so that cylindrical segments fit, preferably snugly, within the aperture of the tube connectors 32. Individual cylindrical segments 31 have a length generally of about 6 to about 48 inches, desirably from about 8 to about 36 inches, and preferably from about 10 to about 12 or about 18 inches. Cylindrical segments 31 can be constructed generally of any materials, such as wood, metal, or polymers, such as fiberglass, polystyrene, ABS, polycarbonate, polyolefin, acetal, nylon or the like, with fiberglass being preferred. Connectors 32 are preferably made of a resilient material or elastomer, but can likewise be formed from wood, metal or polymer, such as described hereinabove with respect to cylindrical segments. In a preferred embodiment, connectors 32 are formed of nylon. The inside diameter of connector 32 aperture is sized to provide a fitted assembly with the outer diameter of cylindrical segments 31. Flagstick 30 preferably includes a flag 34 comprising pocket 36 having an opening at one end into which a portion of a cylindrical segment 31 can be inserted. In a preferred embodiment, the flagstick comprises from about 2 to about 6 cylindrical segments and from 1 to about 4 connectors. In an alternative embodiment, the cylindrical segments include a first end having a projection and a second end with a recess capable of accepting a projection of another cylindrical segment.

The golf practice device 10 additionally includes one or more markers 36. Markers 36 are preferably constructed from the same material as cylindrical segments 31 and flagstick 30. Markers 36 can be the same or different colors and provide means to mark off distances of play from the base member 11. A golfer 40, or a group of golfers can consistently return to the desired distance of practice or competition within the field of play 20, to again practice or compete hitting golf balls 41 closest to target area 19 or "hole" indicated by flagstick 30.

Figure 4A:
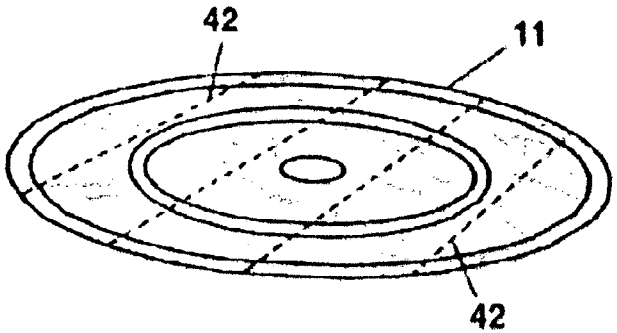
FIGS. 4A through 4C are perspective views of a practice device illustrating an example method in which the device is folded for storage.
Figure 4B:
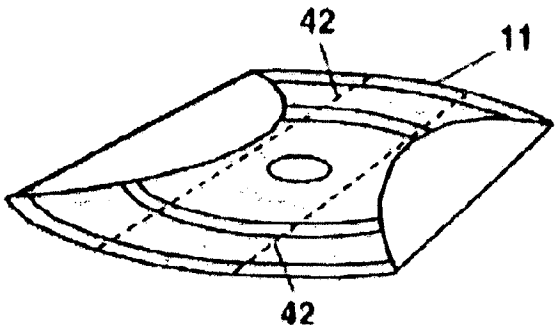
Figure 4C:
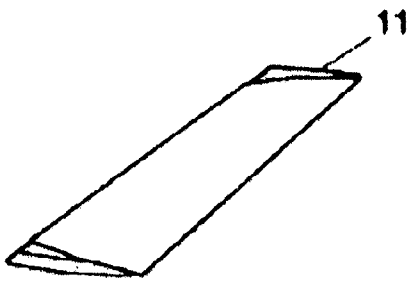
Figure 5:
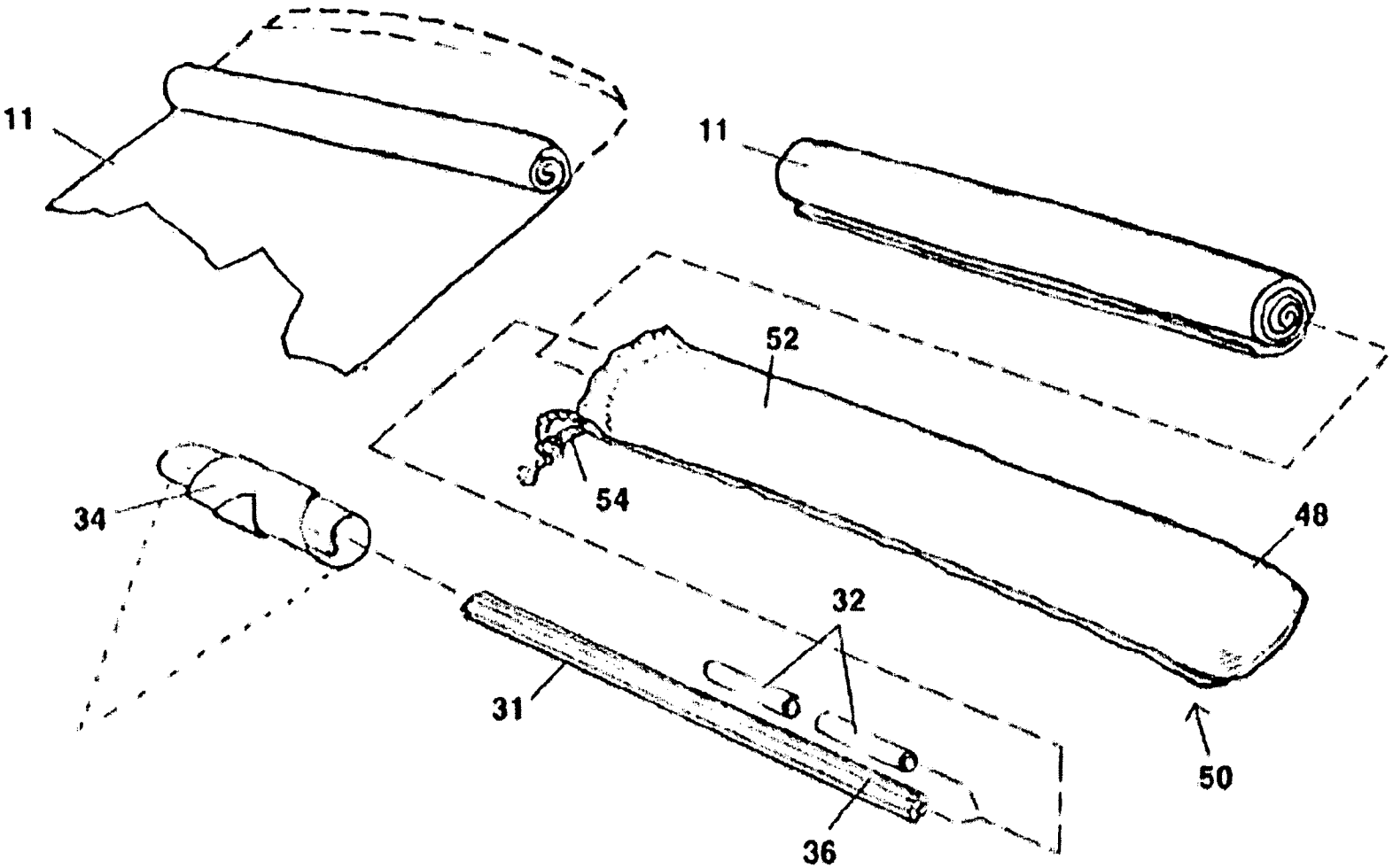
FIG. 5 is an exploded perspective view illustrating an example packing method of the kit within a portable case.

Golf practice device 10 of the present invention in a preferred embodiment includes a storage case 50 as illustrated in FIG. 5, which allows device 10 to be easily portable and even stored in a golf bag of the user when not in use, if desired. FIGS. 4A through 4C illustrate one method for preparing base member 11 for storage within case 50. In this embodiment, the base member 11 is folded along pleats 42 which can be created at manufacture to aid the user fold and roll the golf practice device 10 for storage. As illustrated in the Figures, it is preferred that the outer portions of the material are folded a first time and yet again until the construction at FIG. 4C is attained. In a further embodiment, base member 11 is free of pleats and is rolled into a cylinder such as shown in FIG. 5 before insertion into case 50.

As illustrated in FIG. 5, the folded base member from FIG. 4C or the unfolded base member 11 itself can be rolled in a preferably snug manner into a substantially cylindrical roll. The rolled or folded base member is placed in storage case 50 such as a bag, container, pouch, or the like preferably having a resealable opening at one end which can removably receive the remaining components of golf practice device 10 for storage therein. Case 50 is sized as appropriate to accommodate or house the remaining components of the golf practice device including, but not limited to, base member 11, securing elements 18, and flagstick 30. In one embodiment as illustrated in FIG. 5, flag 34 can be rolled around group's cylindrical segments 31 and markers 36. This group of components along with connectors 32 can be situated adjacent to base member 11 in case 50. In one embodiment, case 50 includes two separate compartments formed utilizing a piece of material running the length of the interior of the case where in one side, the base member 11 is placed, and in the other side, the remaining components are stored. As stated hereinabove, case 50 preferably includes an end closure 54, such as a zipper or drawstring, or the like as illustrated in FIG. 5.

Figure 6:
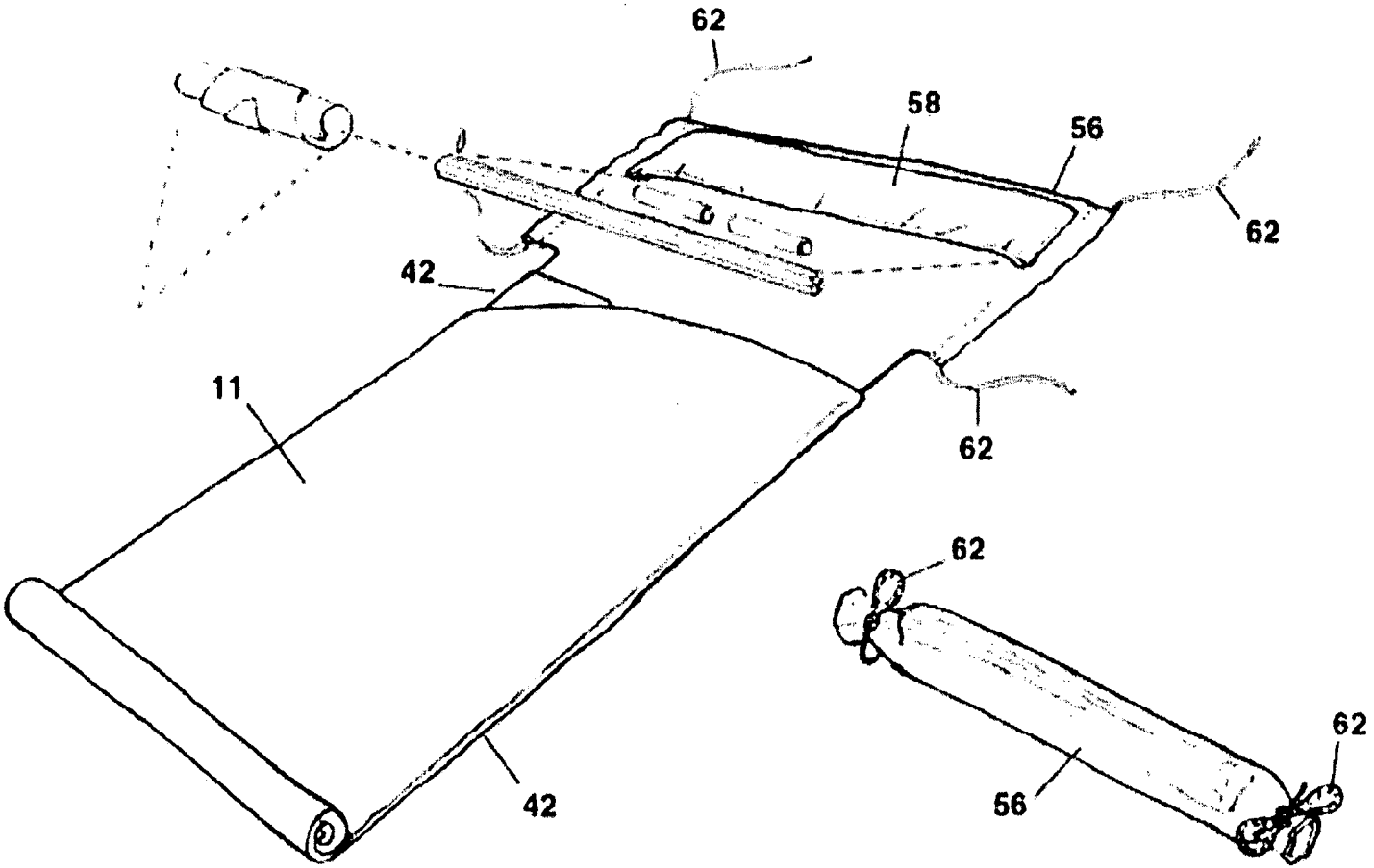
FIG. 6 is an exploded perspective view illustrating an alternate packing assembly of the device of the invention in a portable case.

Referring to FIG. 6, an alternative embodiment to construction of the golf practice device 10 and a packing method is shown. The base member 11 includes a storage flap portion 56 that is connected to and extends outward from a portion of base member 11 such as shown in FIG. 6, preferably in line with the aforementioned pleats 42, if present. The flap portion 56 features a pocket 58 that is sized such to accommodate the aforementioned components of device 10 of the present invention. During use, flap portion 56 and pocket 58 can be folded underneath base member 11, and maintained by securing elements 18. In this manner, storage flap portion 56 is hidden from view and does not interfere with use of the remaining members of device 10 such as base member 11 during a game or practice session. In one embodiment, the device can be folded for storage within storage flap portion 56 as follows.

Base member 11 is folded such as at pleats 42 as illustrated in FIG. 6, so that the base member has a length narrower than the length of pocket 58. An end portion of base member 11 opposite storage flap portion 56 is rolled toward storage flap portion 56. The remaining portions of device 10, such as cylindrical segments 31, connectors 32 and flag 34 can also be rolled into base member 11 if desired. The components of device 10 are positioned within storage flap portion 56 and pocket 58 and can be secured by end closure 62. In this manner, device 10 of the present invention is easily portable from one location to another.

In accordance with the patent statutes, the best mode and preferred embodiment have been set forth; the scope of the invention is not limited thereto, but rather by the scope of the attached claims.

What is claimed is:

1. A golf practice device, comprising:

a base member adapted to be conformable to a ground surface and including a target area having a flagstick orifice and one or more securing element orifices, wherein the base member is flexible and free of a rigid member, wherein the base member includes indicia, and wherein the indicia includes one or more annular rings encircling the target area and located a predetermined radial distance from the target area;

a flagstick comprising a flag, at least two elongated cylindrical segments and a member for connecting the elongated cylindrical segments;

one or more securing elements having a head and a base capable of each extending through one of the securing element orifices for securing the base member to the ground surface; and a case in which the base member, flagstick, and one or more securing elements are storable, and wherein the base member includes an end closure for releasably securing the case.

2. The golf practice device according to claim 1, wherein the head of the securing element is larger than the securing element orifice, and wherein the one or more securing element orifices are located around the periphery of the base member.

3. The golf practice device according to claim 1, wherein the base member includes one or more pleats, or wherein the device includes one or more markers to provide a means of designating distance from the base member.

4. The golf practice device according to claim 1, wherein the flagstick comprises from about 2 to about 6 cylindrical segments, and wherein from about 1 to about 4 connectors are present.

5. The golf practice device according to claim 4, wherein the base member is substantially planar in an open position and is substantially circular having a diameter from about 3 to about 5 feet.

6. The golf practice device according to claim 1, wherein the device further includes a storage flap portion comprising a pocket in which at least the base member is storable when not in use.

7. A golf practice device, comprising:

a base member having a target area, wherein the base member includes a flagstick orifice and one or more securing element orifices, wherein the device further includes one or more securing elements having a head and a base capable of securing the base member to the ground surface; wherein the base member is flexible and free of a rigid member, and wherein the one or more securing elements are golf tees;

a flagstick;

a flag; and a storage flap portion connected to the base member wherein the base member can be housed within the storage flap portion.

8. The golf practice device according to claim 7, wherein the storage flap portion includes a pocket having a length, a width and a height in which the base member can be housed.

9. The golf practice device according to claim 8, wherein the base member includes indicia.

10. The golf practice device according to claim 9, wherein the indicia includes one or more annular rings encircling the target area and located a predetermined distance from the target area.

11. The golf practice device according to claim 9, wherein the flagstick comprises at least two elongated cylindrical segments and a connector for connecting the elongated cylindrical segments.

12. The golf practice device according to claim 9, wherein the base member includes one or more pleats, or wherein the device includes one or more markers to provide a means of designating distance from the base member.

13. The golf practice device according to claim 11, wherein the flagstick comprises from about 2 to about 6 cylindrical segments and from about 1 to about 4 connectors.

14. The golf practice device according to claim 8, wherein the base member is substantially planar in an open position and is substantially circular having a diameter from about 3 to about 5 feet.

15. A golf practice device, comprising:

a base member having a target area, wherein the base member includes indicia, wherein the base member includes one or more pleats or wherein the device includes one or more markers, wherein the base member includes a flagstick orifice and one or more securing element orifices, wherein the device further includes one or more securing elements having a head and a base capable of securing the base member to the ground surface; wherein the base member is flexible and free of a rigid member, and wherein the one or more securing elements are golf tees;

a flagstick;

a flag; and a storage flap portion connected to the base member wherein the base member can be housed within the storage flap portion, and wherein the storage flap portion includes a pocket having a length, a width and a height in which the base member can be housed.

16. The golf practice device according to claim 15, wherein the base member is substantially planar in an open position and is substantially circular having a diameter from about 3 to about 5 feet.

17. The golf practice device according to claim 15, wherein the flagstick comprises from about 2 to about 6 cylindrical segments and from about 1 to about 4 connectors.

18. The golf practice device according to claim 15, wherein the indicia includes one or more annular rings encircling the target area and located a predetermined distance from the target area.

* * * * *